US006793506B1

(12) United States Patent
Hirata et al.

(10) Patent No.: US 6,793,506 B1
(45) Date of Patent: Sep. 21, 2004

(54) BOARD-TO-BOARD ELECTRICAL CONNECTOR ASSEMBLY

(75) Inventors: Toshihisa Hirata, Yamato (JP); Masami Sasao, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/648,904

(22) Filed: Aug. 27, 2003

(51) Int. Cl.[7] ..... H01R 9/09
(52) U.S. Cl. ..... 439/74; 439/65
(58) Field of Search ..... 439/65, 74, 78, 439/83

(56) References Cited

U.S. PATENT DOCUMENTS

| | | | | |
|---|---|---|---|---|
| 5,161,985 A | | 11/1992 | Ramsey | 439/74 |
| 5,199,884 A | * | 4/1993 | Kaufman et al. | 439/74 |
| 5,259,795 A | * | 11/1993 | Yamada et al. | 439/751 |
| 5,445,529 A | | 8/1995 | Yamamoto | 439/81 |
| 5,545,051 A | | 8/1996 | Summers et al. | 439/350 |
| 5,599,192 A | | 2/1997 | Olson | 439/65 |
| 5,813,871 A | | 9/1998 | Grabbe et al. | 439/108 |
| 5,830,018 A | | 11/1998 | Simmel | 439/660 |
| 5,836,773 A | | 11/1998 | McHugh et al. | 439/74 |
| 5,882,212 A | | 3/1999 | McHugh et al. | 439/74 |
| 5,885,092 A | * | 3/1999 | Ito et al. | 439/74 |
| 5,975,916 A | * | 11/1999 | Okura | 439/74 |

* cited by examiner

*Primary Examiner*—Renee Luebke
(74) *Attorney, Agent, or Firm*—Stephen Z. Weiss

(57) ABSTRACT

A board-to-board electrical connector assembly is provided for effecting a connection between two circuit boards. The assembly includes a first connector having a low profile dielectric housing including a mating face and a mounting face for mounting the connector on a first circuit board. A plurality of spaced mating posts project from the mating face of the housing. A second connector has a low profile dielectric housing including a mating face for mating with the mating face of the first connector and a mounting face for mounting on a second circuit board. The dielectric housing of the second connector includes a plurality of mating passages in the mating face thereof for receiving the mating posts of the first connector. The passages extend from the mating face all the way to and through the mounting face of the dielectric housing of the second connector.

12 Claims, 4 Drawing Sheets

BOARD-TO-BOARD ELECTRICAL CONNECTOR ASSEMBLY

FIELD OF THE INVENTION

This invention generally relates to the art of electrical connectors and, particularly, to an electrical connector assembly for effecting a connection between two circuit boards.

BACKGROUND OF THE INVENTION

A variety of electrical connectors have been used to make electrical connections between the circuits on different printed circuit boards. These printed circuit boards must be joined together with connectors in a manner to effectively and reliably interconnect the circuits on one circuit board to the circuits on another circuit board. This is done by a pair of mating connectors which are surface mount connectors and may include a male or plug connector mateable with a female or receptacle connector to form a board-to-board electrical connector assembly.

As stated above, both connectors of the electrical connector assembly are surface mount connectors. Both connectors typically have a low profile and have some form of mechanism to hold the connectors together. The holding mechanism preferably aligns the connectors, prevents the two connectors from wobbling and maintains the terminals of the connectors in good, positive interengagement.

Whatever holding mechanism is used to hold the connectors in mated condition, considerable constraints are placed on the design of the mechanism due to the very low profile of the connectors. For instance, mating posts may be used on one connector for insertion into mating passages of the other connector. The posts are press-fit into the passages and may be used to properly align the connectors. However, the passages extend into one of the connector housings only a limited distance which, in many instances, is insufficient to prevent the connectors from wobbling. This problem is further magnified if the mating posts are beveled. In other words, in order to facilitate blind mating of the connectors in most applications, the mating posts have beveled distal ends. This shortens the effective length of the posts which further causes problems in trying to prevent the connectors from wobbling and in trying to maintain a good, positive connection between the respective terminals. The present invention is directed to solving these various problems, particularly in a board-to-board electrical connector assembly wherein the respective connectors have very low profiles.

SUMMARY OF THE INVENTION

An object, therefore, of the invention is to provide a new and improved board-to-board electrical connector assembly for effecting a connection between two circuit boards.

In the exemplary embodiment of the invention, the connector assembly includes a first connector having a low profile dielectric housing including a mating face and a mounting face for mounting the connector on a first circuit board. A plurality of spaced mating posts project from the mating face of the housing. A plurality of first terminals are mounted on the dielectric housing and each terminal includes a tail portion for connection to an appropriate circuit trace on the first circuit board and a contact portion exposed generally at the mating face of the housing.

A second connector has a low profile dielectric housing including a mating face for mating with the mating face of the housing of the first connector, and a mounting face for mounting on a second circuit board. A plurality of mating passages are provided in the housing for receiving the mating posts of the first connector. The passages extend from the mating face to and through the mounting face of the dielectric housing of the second connector. A plurality of second terminals are mounted on the dielectric housing of the second connector. Each second terminal includes a tail portion for connection to an appropriate circuit trace on the second circuit board, and a contact portion for engaging the contact portion of one of the first terminals of the first connector.

The invention contemplates that the mating posts of the first connector be snugly fit in the mating passages of the second connector, with the mating posts extending all the way to the mounting face of the second connector to align the connectors, to prevent wobbling of the connectors and to maintain the contact portions of the terminals in engagement.

According to one aspect of the invention, the mating posts of the first connector have distal ends which are beveled to facilitate blind mating of the connectors. The distal ends of the mating posts are generally flush with the mounting face of the second connector when the connectors are mated.

According to another aspect of the invention, the dielectric housing of the first connector is generally rectangular and includes four of the mating posts generally at four corners of the housing. The first connector comprises a plug connector, and the second connector comprises a receptacle connector having a generally rectangular receptacle means having four of the mating passages at four corners of the receptacle means.

Other features of the invention include at least one of the mating posts and a corresponding mating passage being of a different size from another mating post and corresponding mating passage to provide a polarization means for the connector assembly. The dielectric housing of at least one of the connectors may include a plurality of terminal-mounting holes in the mating face of the housing, whereby the terminals are mounted to the housing through the mating face opposite the mounting face which is mounted to the respective circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 9:
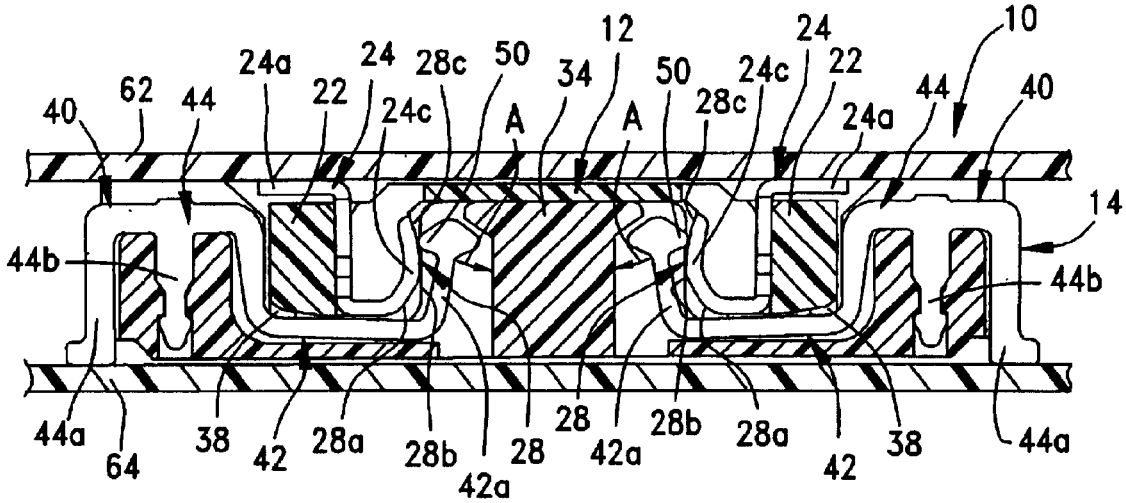
FIG. 9 is a vertical section through the connector assembly of the invention, generally in the area of the section of FIG. 5, with the plug and receptacle connectors in mated condition.

Referring to the drawings in greater detail, the invention is embodied in an electrical connector assembly, generally designated 10 in FIG. 9, which includes a first or plug connector, generally designated 12 and shown specifically in FIGS. 1–4. The plug connector is mateable with a second or receptacle connector, generally designated 14, which is shown specifically in FIGS. 5–8.

Figure 1:
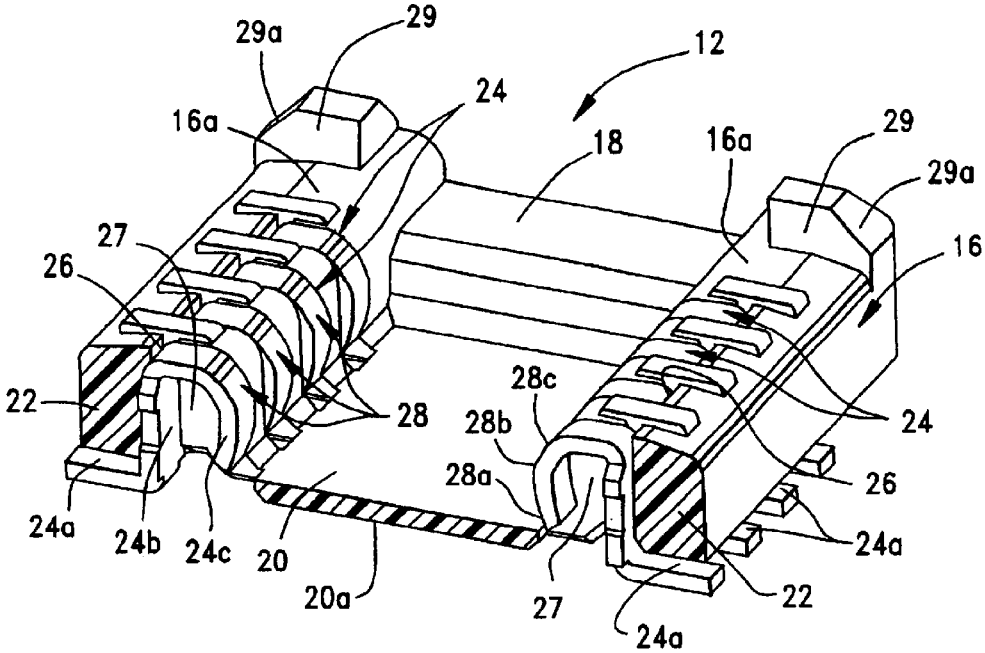
FIG. 1 is a vertically sectioned perspective view of the first or plug connector of the connector assembly according to the invention.
Figure 2:
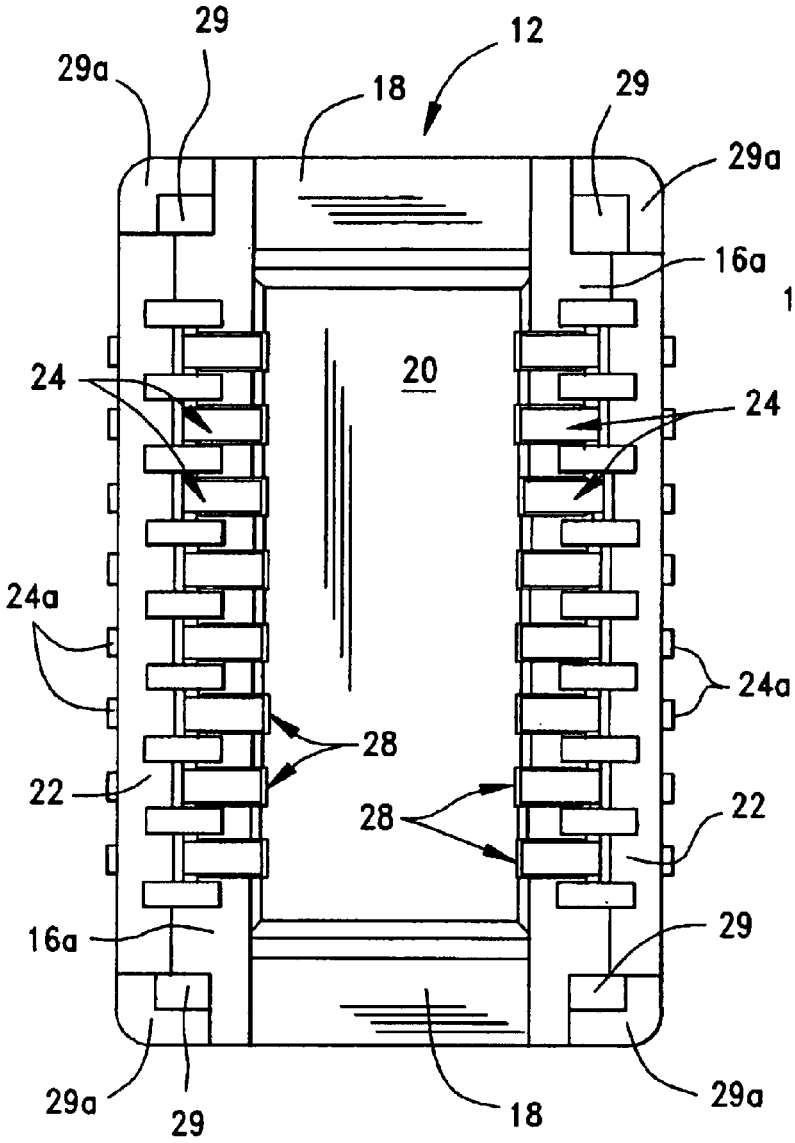
FIG. 2 is a top plan view of the plug connector.
Figure 3:
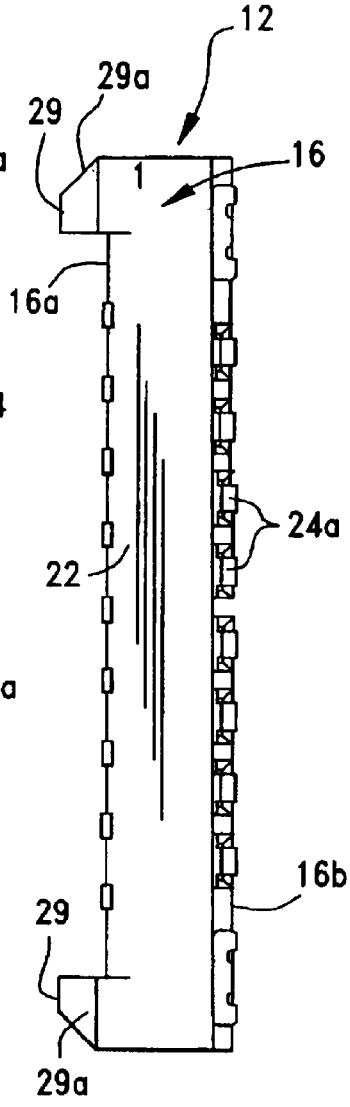
FIG. 3 is a side elevational view of the plug connector.
Figure 4:
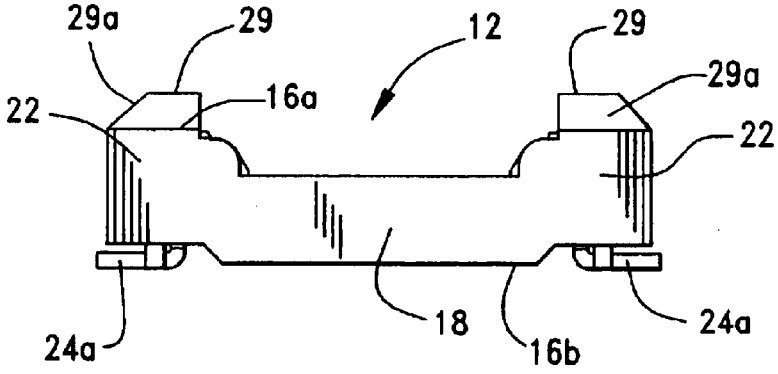
FIG. 4 is an end elevational view of the plug connector.

Referring first to FIGS. 1–4, the first or plug connector 12 includes a dielectric housing, generally designated 16, which may be molded of plastic material or the like. Housing 16 has a mating face 16*a* and a mounting face 16*b* for mounting plug connector 12 on a first circuit board (not shown). The housing is elongated as best seen in FIG. 2 and includes a pair of opposite ends 18 joined by a base wall 20 which defines an outside surface 20*a* for surface mounting the plug connector on the first circuit board. A pair of elongated plug portions 22 of housing 16 extend between opposite ends 18 along opposite sides of base wall 20.

A plurality of first or plug terminals, generally designated 24, are mounted in housing 16 of plug connector 12. As best seen in FIGS. 1 and 2, the terminals are mounted along an inside surface 26 of each plug portion 22 of the housing, thereby defining two spaced rows of terminals facing inwardly of the connector. Each plug terminal 24 includes a tail portion 24*a* which is generally flush with surface 20*a* of base wall 20 for connection to an appropriate circuit trace on the first circuit board. The remainder of each plug terminal 24 is generally U-shaped with one leg 24*b* of the U-shape defining a mounting portion for mounting the terminal in plug portion 22 of housing 16. Leg 24*b* has teeth on opposite edges thereof for skiving into the plastic material of the housing. An opposite leg 24*c* of the U-shape defines a convex contact portion of each terminal. The housing defines an open space 27 between mounting portion 24*b* and convex contact portion 24*c* so that the convex contact portion is free to flex upon engagement with a terminal of the receptacle connector as described hereinafter.

The convex contact portion 24*c* of each plug terminal 24 defines a continuous arcuate contact surface, generally designated 28 in FIG. 1. Each continuous arcuate contact surface 28 includes an initial surface portion 28*a* as seen in FIG. 1, along with a maximum force surface portion 28*b* and a final latched surface portion 28*c*, all for purposes described hereinafter.

The invention contemplates that a plurality of mating posts 29 be formed integrally with housing 16 so that the mating posts project from mating face 16*a* of the housing. As best seen in FIG. 2, the housing is rectangular, and four mating posts 29 are provided at the four corners of the rectangular housing. As can be understood hereinafter in the description of FIG. 9, the mating of connectors 12 and 14 is performed under blind mating conditions because the circuit boards block visualizing the mating faces of the connectors. Therefore, mating posts 29 are beveled, as at 29*a*, to facilitate the mating of the connectors under the blind mating conditions.

Referring to FIGS. 5–8, receptacle connector 14 includes a dielectric housing, generally designated 30, which, like plug connector 12, is elongated and includes opposite ends 32. Housing 30 has a mating face 30*a* for mating with the mating face of housing 16 of plug connector 12. The housing includes a center rib 34 and a pair of side ribs 36 which extend between opposite ends 32 and define a pair of elongated receptacles, generally designated 38, which receive plug portions 22 and plug terminals 28 of plug connector 12, as will be seen hereinafter.

A plurality of second or receptacle terminals, generally designated 40, are mounted on each side rib 36 of housing 30 of receptacle connector 14. Each receptacle terminal 40 includes a generally U-shaped contact section, generally designated 42, and a mounting section, generally designated 44. The mounting section includes a tail portion 44*a* for connection to an appropriate circuit trace on a second circuit board (not shown). The bottom of tail portion 44*a* is generally flush with a bottom surface 36*a* of each side rib 36 and a bottom surface 34*a* of center rib 34. Bottom surfaces 34*a* and 36*a*, in essence, form a mounting face for mounting connector 14 on the second circuit board. Therefore, receptacle connector 14 is designed for surface mounting on the second circuit board. Mounting section 44 of each receptacle terminal 40 includes a toothed mounting leg 44*b* for insertion into a respective mounting hole 46 in each side rib 36 of housing 30.

The generally U-shaped contact section 42 of each receptacle terminal 40 includes a first leg 42*a* spaced from a second leg 42*b* to define an open space therebetween which is coincident with one of the receptacles 38 which run the length of the receptacle connector. Leg 42*a* of the U-shaped contact section 42 forms a flexible contact arm which has an inwardly directed contact projection 50 on the distal end of the flexible contact arm.

From the foregoing, it can be understood that terminals 40 are "top loaded" terminals. In other words, mounting legs 44*b* of the terminals are press-fit into mounting holes 46 in ribs 36 of housing 30 from top face 30*a* of the housing. By providing top loaded terminals, the housing will not be able to be removed from the second circuit board without removal of the terminals from the board. This would be extremely difficult since tail portions 44*a* of all of the terminals are connected, as by soldering, to circuit traces on the second circuit board. Heretofore, if sufficient upward forces were placed on the connector housing of prior art connectors, the housing could be lifted off of the circuit board, leaving the terminals in place on the board or bending or damaging the terminals due to the extraneous external forces.

Receptacle connector 14 is further secured to the second circuit board by four metal "fitting nails" 52 which are secured in recesses 54 near the four corners of housing 30. Each fitting nail 52 has a foot portion 52*a* which is securely fixed, as by soldering, to an appropriate mounting pad on the second circuit board.

Figure 5:
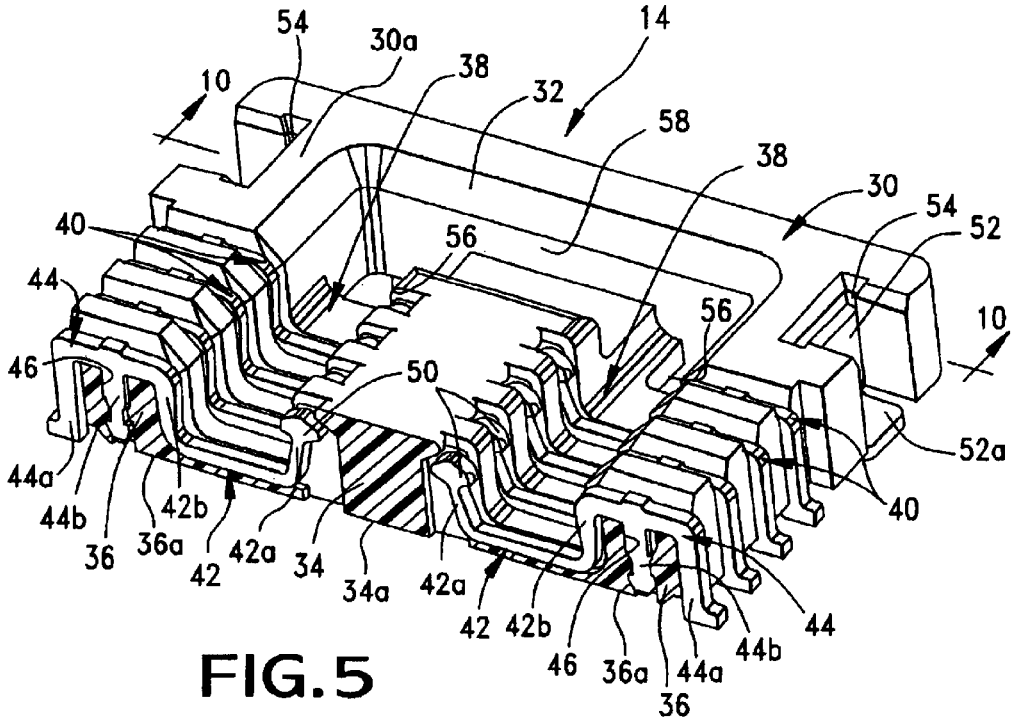
FIG. 5 is a vertically sectioned perspective view of the second or receptacle connector of the connector assembly according to the invention.
Figure 6:
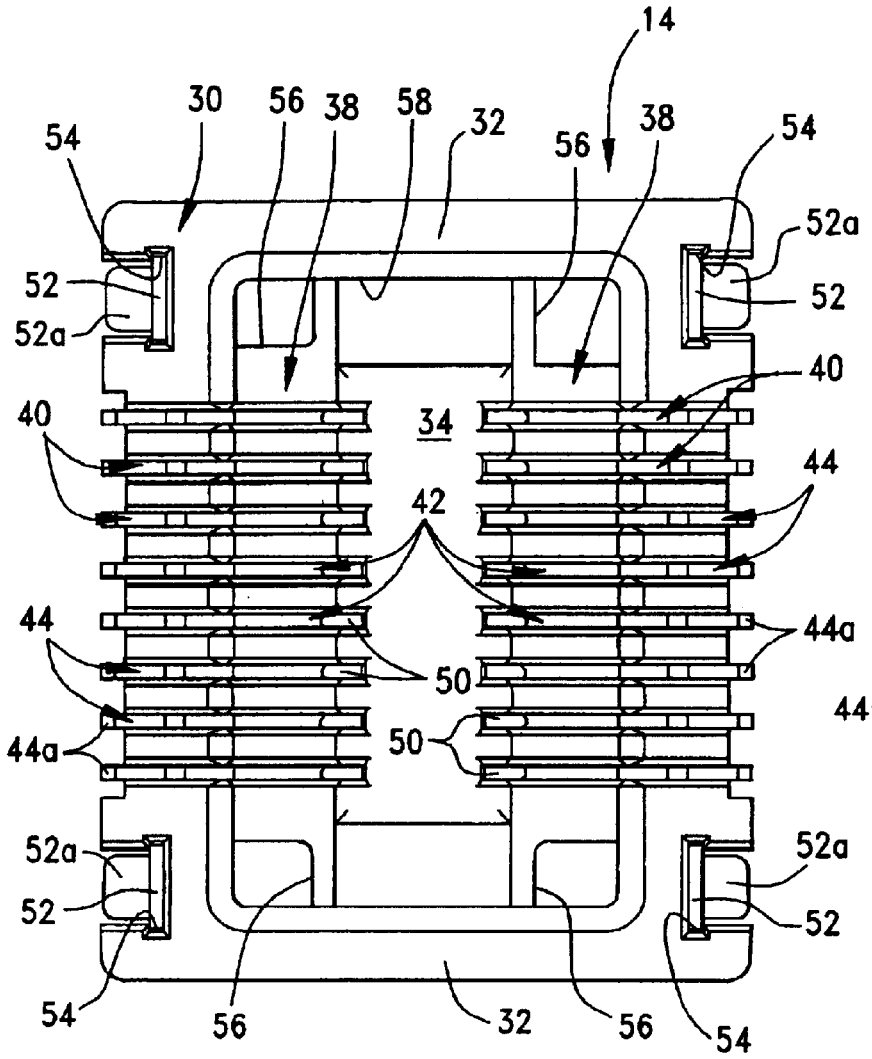
FIG. 6 is a top plan view of the receptacle connector.
Figure 7:
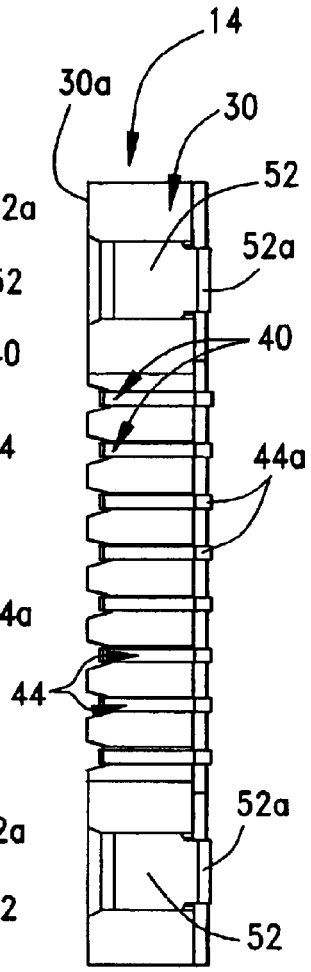
FIG. 7 is a side elevational view of the receptacle connector.
Figure 8:
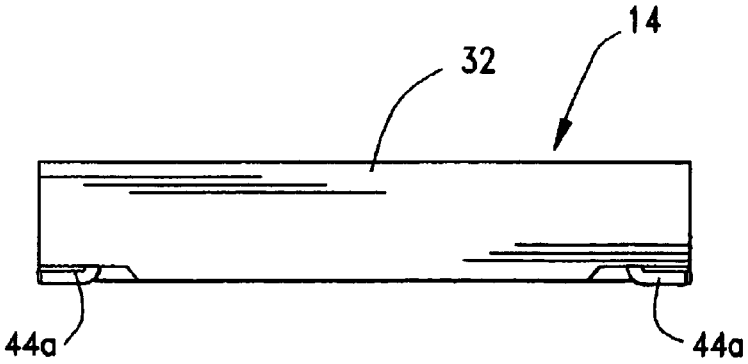
FIG. 8 is an end elevational view of the receptacle connector.

The invention contemplates that housing 30 of receptacle connector 14 be provided with four mating passages 56 for receiving mating posts 29 of plug connector 12. These passages are seen best in FIGS. 5 and 6. In essence, the passages effectively extend all the way from mating face 30*a* of the housing to and through the mounting face formed by bottom surfaces 34*a* and 36*a* of the housing. As best seen in FIGS. 5 and 6, elongated receptacles 38 form part of an overall receptacle means 58 between opposite ends 32 and side ribs 36 of housing 30. This receptacle means 58 is generally rectangular and sized for receiving rectangular plug connector 12. During mating, mating posts 29 of the plug connector are inserted into mating passages 56 of the receptacle connector.

FIG. 9 shows the first or plug connector 12 fully mated with the second or receptacle connector 14. The plug connector is shown surface mounted to a first circuit board 62, and receptacle connector 14 surface is mounted to a second circuit board 64. FIG. 9 shows the plug connector mated downwardly into the receptacle connector. However, it should be understood that the board-to-board connector assembly 10 is omni-directional in use and function, and this orientation of the respective connectors 12 and 14 is but for illustration purposes.

With that understanding, it can be seen that plug portions 22 and convex contact portions 24*c* of plug connector 12 are inserted into receptacles 38 formed by the U-shaped contact sections 42 of receptacle terminals 40. During mating, flexible contact arms 42*a* of the receptacle terminals are biased inwardly in the direction of arrows "A", as contact projections 50 at the distal ends of flexible contact arms 42*a* ride along continuous arcuate contact surfaces 28 of convex contact portion 24*c* of plug terminals 24. During the mating process, contact projections 50 first engage initial surface portions 28*a* of the continuous arcuate contact surfaces at minimal engaging forces. As contact projections 50 ride over surface portions 28*b,* maximum forces are encountered until contact projections 50 reach the final latched surface portions 28*c* whereat minimal mating forces are encountered at the fully mated condition of the connectors. The combined forces of all of the contact projections 50 of all of the receptacle terminals with the final latched surface portions 28*c* of all of the plug terminals provide a good latching means between the two connectors with little or no additional insertion forces. The continuous arcuate contact surfaces 28 are immune to any tolerance problems of the positive latching mechanisms of the prior art.

Figure 10:
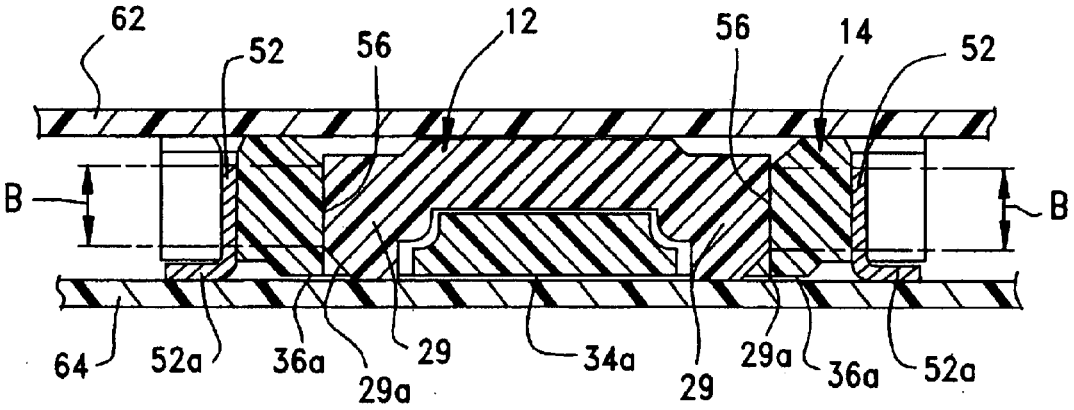
FIG. 10 is a vertical section through the connector assembly in mated condition and taken generally in the area of line 10—10 of FIG. 5.

FIG. 10 shows plug connector 12 fully mated with receptacle connector 14 to electrically interconnect the first and second circuit boards 62 and 64, respectively. Mating posts 29 of the plug connector can be seen inserted into mating passages 56 of the receptacle connector. The distal ends of the posts are generally flush with the bottom mounting face of the receptacle connector. Because mating posts 29 extend all the way down to and through mounting face 34*a*/36*a* of the receptacle connector, considerable surface areas of engagement are provided between mating posts 29 of the plug connector and mating passages 56 of the receptacle connector. These interengaging surface areas are indicated by double-headed arrows "B". These considerable interengaging surface areas are provided notwithstanding the fact that mating posts 29 are beveled, as at 29*a,* to facilitate blind mating of the connectors. These significant interengaging surfaces are afforded because the mating posts extend all the way through the receptacle connector.

FIGS. 2 and 6 show that one or more (e.g., the upper right-hand corner) of the mating posts 29 and mating passages 56 can be of a different size (e.g., larger) than another mating post and passage. This provides a polarization means for the connector assembly so that connectors 12 and 14 can be mated in only one orientation.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A board-to-board electrical connector assembly for effecting a connection between two circuit boards, comprising:

a first connector having a low profile generally rectangular dielectric housing including a mating face and a mounting face for mounting the connector on a first circuit board, and a plurality of spaced mating posts projecting from the mating face of the housing at four corners of the housing, each of the mating posts defined in part by two outer walls located in a respective corner of the housing;

a plurality of first terminals mounted on the dielectric housing and each terminal including a tail portion for connection to an appropriate circuit trace on the first circuit board and a contact portion exposed generally at said mating face;

a second connector having a low profile dielectric housing including a mating face for mating with the mating face of the housing of the first connector and a mounting face for mounting on a second circuit board, and a plurality of mating passages for receiving the outer walls of the mating posts of the first connector, the passages extending from the mating face through the mounting face of the dielectric housing of the second connector and having inner walls forming the four corners;

a plurality of second terminals mounted on the dielectric housing of the second connector and each second terminal including a tail portion for connection to an appropriate circuit trace on the second circuit board and a contact portion for engaging the contact portion of one of the first terminals of the first connector; and said outer walls of the mating posts of the first connector being snugly fit against the inner walls of the mating passages of the second connector, with the outer walls of the mating posts extending all the way to the mounting face of the second connector to align the connectors, to prevent wobbling of the connectors and to maintain the contact portions of the terminals in engagement.

2. The board-to-board electrical connector assembly of claim 1 wherein said mating posts of the first connector have distal ends which are generally flush with the mounting face of the second connector when the connectors are mated.

3. The board-to-board electrical connector assembly of claim 1 wherein said mating posts of the first connector have distal ends which are beveled to facilitate blind mating of the connectors.

4. The board-to-board electrical connector assembly of claim 3 wherein said distal ends of the mating posts are generally flush with the mounting face of the second connector when the connectors are mated.

5. The board-to-board electrical connector assembly of claim 1 wherein the dielectric housing of said first connector is generally rectangular, and includes four of said mating posts generally at four corners of the housing.

6. The board-to-board electrical connector assembly of claim 5 wherein said first connector comprises a plug connector and said second connector comprises a receptacle connector having a generally rectangular receptacle means having four of said mating passages at four corners of the receptacle means.

7. The board-to-board electrical connector assembly of claim 1 wherein at least one of said mating posts and a corresponding mating passage is of a different size from another mating post and corresponding mating passage to provide a polarization means for the connector assembly.

8. The board-to-board electrical connector assembly of claim 1 wherein the dielectric housing of at least one of said connectors includes a plurality of terminal-mounting holes in the mating face of the housing whereby the terminals are mounted to the housing through the mating face opposite the mounting face which is mounted to the respective circuit board.

9. A board-to-board electrical connector assembly for effecting a connection between two circuit boards, comprising:

a plug connector having a low profile generally rectangular dielectric housing including a mating face and a mounting face for mounting the connector on a first circuit board, and a plurality of mating posts projecting from the mating face of the housing generally at four corners of the housing, the mating posts having distal ends which are beveled to facilitate blind mating of the connectors and defined in part by two outer walls located in a respective corner of the housing;

a plurality of first terminals mounted on the dielectric housing and each terminal including a tail portion for connection to an appropriate circuit trace on the first circuit board and a contact portion exposed generally at said mating face;

a receptacle connector having a low profile dielectric housing including a mating face for mating with the mating face of the housing of the plug connector and a mounting face for mounting on a second circuit board, the housing having a generally rectangular receptacle means in the mating face thereof for receiving the generally rectangular plug connector, and a plurality of mating passages at four corners of the receptacle means for receiving the mating posts of the plug connector, the passages extending from the mating face through the mounting face of the dielectric housing of the receptacle connector;

a plurality of second terminals mounted on the dielectric housing of the receptacle connector and each second terminal including a tail portion for connection to an appropriate circuit trace on the second circuit board and a contact portion for engaging the contact portion of one of the first terminals of the plug connector; and said outer walls of the mating posts of the plug connector being snugly fit against the inner walls of the mating passages of the receptacle connector, with the outer walls of the mating posts extending all the way to the mounting face of the receptacle connector to align the connectors, to prevent wobbling of the connectors and to maintain the contact portions of the terminals in engagement.

10. The board-to-board electrical connector assembly of claim 9 wherein at least one of said mating posts and a corresponding mating passage is of a different size from another mating post and corresponding mating passage to provide a polarization means for the connector assembly.

11. The board-to-board electrical connector assembly of claim 9 wherein the dielectric housing of at least one of said connectors includes a plurality of terminal-mounting holes in the mating face of the housing whereby the terminals are mounted to the housing through the mating face opposite the mounting face which is mounted to the respective circuit board.

12. The board-to-board electrical connector assembly of claim 9 wherein said mating posts of the plug connector have distal ends which are generally flush with the mounting face of the receptacle connector when the connectors are mated.

* * * * *